US006273503B1

(12) United States Patent
Cheng

(10) Patent No.: US 6,273,503 B1
(45) Date of Patent: Aug. 14, 2001

(54) HOOK-ON TYPE BABY SEAT

(76) Inventor: Kenny Cheng, No. 16, Lane 47, Chih Feng St., Taipei (TW)

( * ) Notice: Subject to any disclaimer, the term of this patent is extended or adjusted under 35 U.S.C. 154(b) by 0 days.

(21) Appl. No.: 09/632,147

(22) Filed: Aug. 3, 2000

(51) Int. Cl.[7] ..... A47B 39/00
(52) U.S. Cl. ..... 297/174; 297/135; 297/219.12
(58) Field of Search ..... 297/174, 135, 297/219.12

(56) References Cited

U.S. PATENT DOCUMENTS

| | | | | |
|---|---|---|---|---|
| 2,493,187 | * | 1/1950 | Ducey | 297/174 |
| 3,133,760 | * | 5/1964 | Robinson | 297/174 |
| 4,586,746 | * | 5/1986 | Day et al. | 297/174 |
| 4,863,216 | * | 9/1989 | Prescott | 297/174 |
| 5,415,456 | * | 5/1995 | Hart et al. | 297/174 |
| 5,470,127 | * | 11/1995 | Kassai et al. | 297/174 |
| 5,480,211 | * | 1/1996 | Douglas et al. | 297/174 |

* cited by examiner

*Primary Examiner*—Laurie K. Cranmer
(74) *Attorney, Agent, or Firm*—Flehr Hohbach Test Albritton & Herbert LLP

(57) ABSTRACT

Disclosed is a hook-on type baby seat which primarily comprises a main body portion and a seat portion. The main body portion comprises a U-shaped arm assembly for supporting the baby seat on an upper surface of a gripped object, a pair of longitudinal arm members soldered to the U-shaped arm assembly, a pair of gripping arm members for gripping or releasing the gripped object, and a pair of elevation controlling and adjusting members for allowing the pair of gripping arm members to be upwardly and downwardly movable in the elevation direction of the longitudinal arm member. The seat portion comprises a seat cushion and a back portion hanged on the U-shaped arm member by sewing. By adjusting the position along the elevation direction of the longitudinal arm member, the holding ends of the U-shaped arm assembly cooperates with the gripping ends of the pair of the gripping arm members to tightly grip the gripped object while the pair of the elevation controlling and adjusting members are kept in a locking state for further tightly gripping the gripped object.

12 Claims, 6 Drawing Sheets

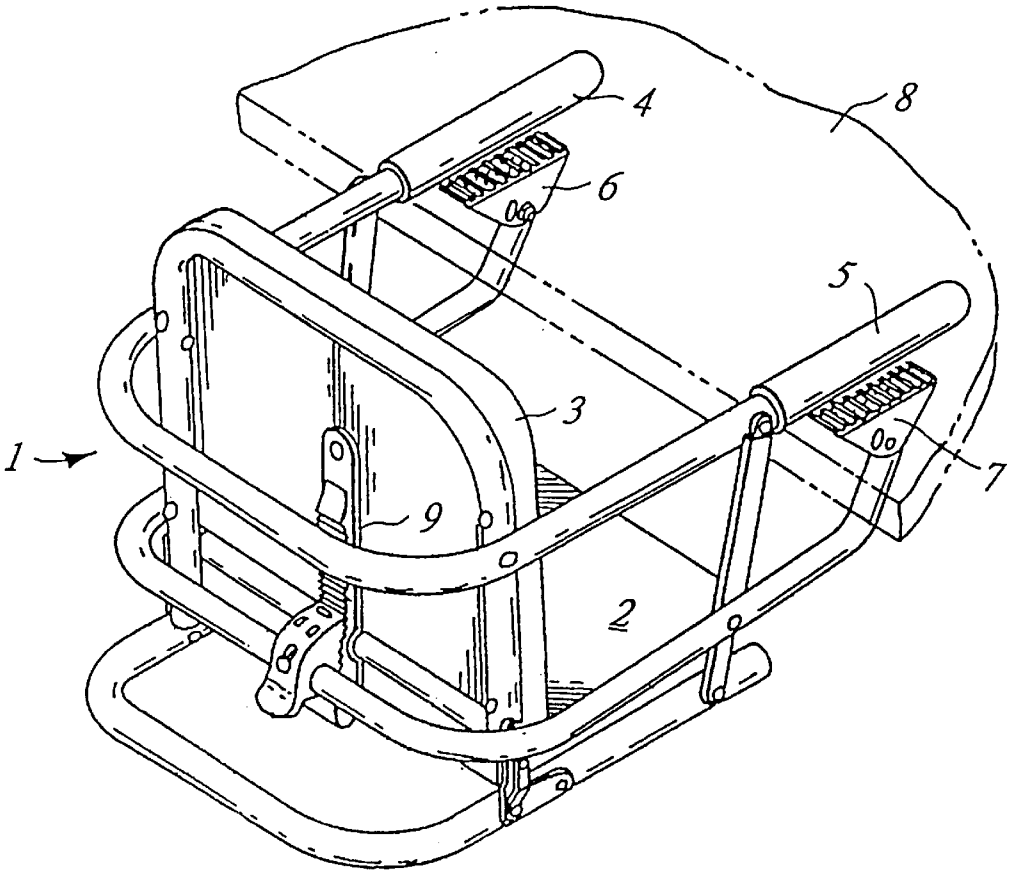
FIG.6
(PRIORART)

HOOK-ON TYPE BABY SEAT

BACKGROUND OF THE INVENTION

1. Field of the Invention

The present invention relates to a baby seat and more particularly, to a hook-on type baby seat which is adapted to be used for gripped objects with various thicknesses. Such a hook-on type baby seat has an elevation adjusting and locking function and can be operated both in safety and in ease.

2. Description of the Related Art

FIG. 6 shows a conventional hook-on type baby seat 1 which comprises a seat portion 2 and a back portion 3 coupled to two forwardly projecting anchor members 4 and 5. The anchor members 4 and 5 are adapted to overlie a table 8. The conventional hook-on type baby seat 1 also comprises a grip means having a pair of free ends 6 and 7 below the anchor members 4 and 5 for gripping a bottom surface of the table 8. The free ends 6 and 7 of the grip means are supported for movement toward and away from the elevation of the anchor members 4 and 5. A latch means 9 extends between the grip means and the back portion of the baby seat 1 for latching the free ends 6 and 7 of the grip means in one of a plurality of positions.

However, the conventional hook-on type baby seat 1 cannot be securely hooked on the table. This is because that simply by the coordination between the free ends 6 and 7 of the grip means and the anchor members 4 and 5, the resultant force generated therebetween is not sufficient to securely hold on the table due to a single-point contact. Therefore, the baby seat 1 is easily separate from the table by simply pulling the baby seat 1 in the horizontal direction.

In addition, since the conventional hook-on type baby seat does not have an elevation-adjusting function, the baby seat will be slanted in some angle. Consequently, the baby seat itself cannot be appropriately adjusted in accordance with the thickness of the table.

To overcome the defects of the conventional hook-on type baby seat described above, the present invention provides an implemented hook-on type baby seat which is simple and labor-saving in operation, comfortable and convenient in use and pleasant to the eyes. In addition, such a hook-on type baby seat has the following advantages, for example, it is convenient in carry and portability due to the compact retracting size and functions of elevation adjustment and safe locking can be achieved.

SUMMARY OF THE INVENTION

An object of the present application is to provide a hook-on type baby seat which makes a further implementation with reference to the defects of the conventional hook-on type baby seat in order to produce a safer and more convenient hook-on type baby seat.

The present invention provides a hook-on type baby seat primarily comprising a main body portion and a seat portion, in which the main body portion comprises a U-shaped arm assembly for supporting the baby seat on an upper surface of a gripped object; a pair of longitudinal arm members and one end of each of the longitudinal arm members is soldered to the U-shaped arm assembly; a pair of gripping arm members for gripping or releasing the gripped object in which one end of each of the gripping arm members is formed to become a gripping end bent upwardly, and the other end thereof is formed to become a C-shaped member for attaching to the corresponding longitudinal arm member; and a pair of elevation controlling and adjusting members combined with the pair of longitudinal arm members and gripping arm members for allowing the pair of gripping arm members to be upwardly and downwardly movable in the elevation direction of the longitudinal arm member so as to adjust and lock an elevation position of the pair of gripping arm members, and the seat portion comprises a seat cushion and a back portion hanged on the U-shaped arm member by sewing, in which a safety belt is provided in the inner side of the seat portion for fastening a baby.

The present invention provides a hook-on type baby seat in which the U-shaped arm assembly substantially comprises a U-shaped arm member, a pair of straight arm members, and a pair of positioning flexible members.

The present invention provides a hook-on type baby seat in which each of said pairs of elevation controlling and adjusting members comprises an elevation adjusting and locking portion, a release-or-grip control portion, a right cover and a left cover, and each of said elevation adjusting and locking portion comprises an adjusting button, a first spring, a locking button, a second spring, a stop strip and a joint block, and each of said release-or-grip control portion comprises a handle bar, a C-shaped movable component, a casing and a third spring. Each of said handle bar is further provided with a rubber pad, and a force is applied to said handle bar by the third spring so that the baby seat is further gripped the gripped object when said handle bar is pulled to a locking position, and the rubber pad on said handle bar is released from the bottom surface of the table to facilitate the separation of the baby seat and the table when said handle bar is pulled to a releasing position.

BRIEF DESCRIPTION OF THE DRAWINGS

The accompanying drawings, which are incorporated in and constitute a part of this specification, illustrate a preferred embodiment of the invention and, together with a general description of the invention given above, and the detailed description of the embodiment given below, serve to explain the principle of the invention, in which

FIG. 6 is perspective view showing a conventional hook-on type baby seat attached to a table.

DETAILED DESCRIPTION OF A PREFERRED EMBODIMENT

An embodiment in accordance with the present application will be described hereinafter with reference to the accompanying drawings by exemplifying a hook-on type baby seat.

Figure 1:
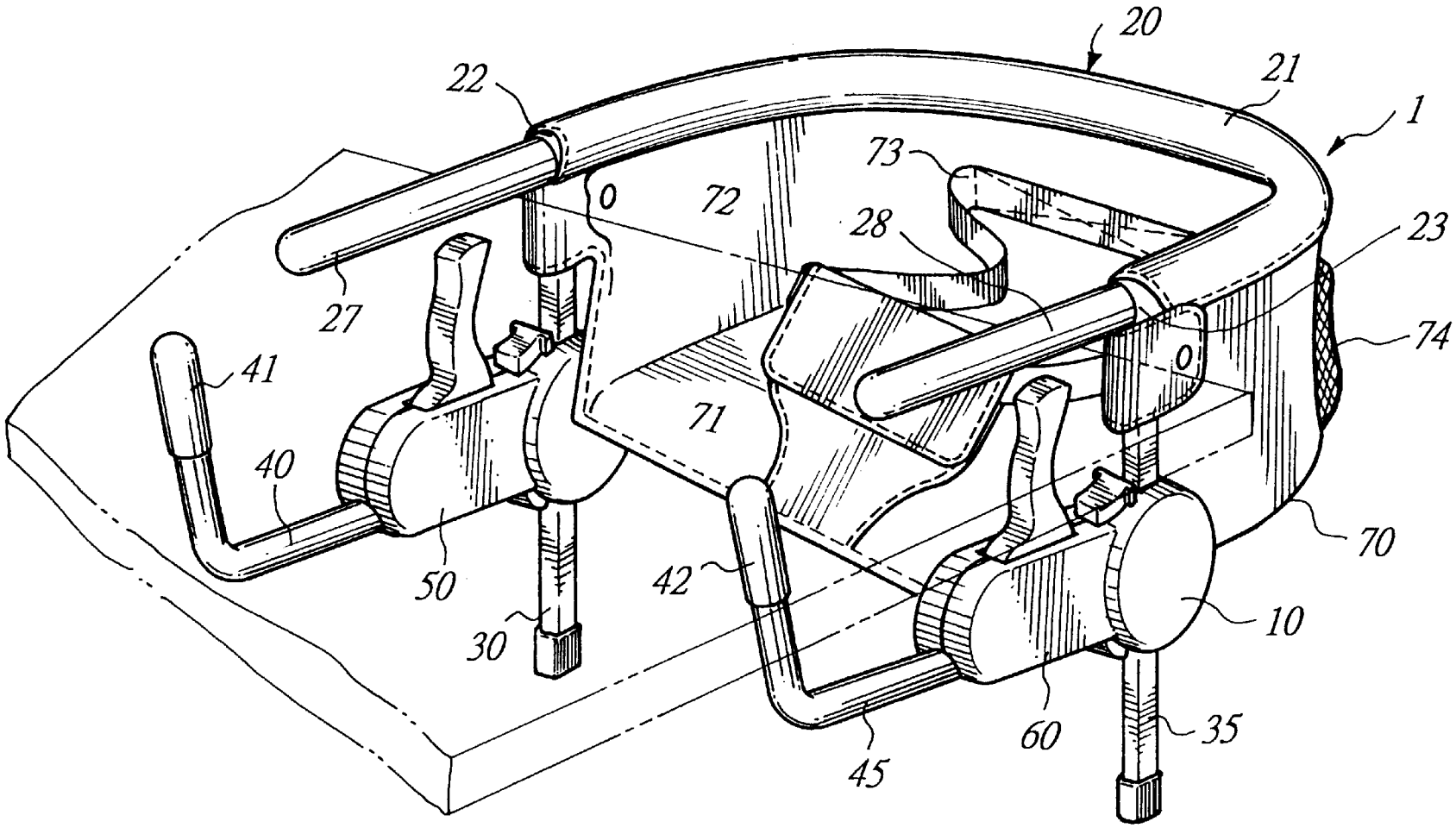
FIG. 1 is a perspective view of a hook-on type baby seat in accordance with the present application.

FIG. 1 is a perspective view of a hook-on type baby seat in accordance with the present application.

As shown in FIG. 1, a hook-on type baby seat 1 in accordance with the present application primarily comprises a main body portion 10 and a seat portion 70. The main body portion 10 is comprised of a U-shaped arm assembly 20, a pair of longitudinal arm members 30 and 35, a pair of gripping arm members 40 and 45, and a pair of elevation controlling and adjusting members 50 and 60. The main body portion 10 can be integrally regarded as a U-shaped arm member with a right and a left clamping portions. For the convenience of illustration, the left clamping portion is exemplarily described.

Figure 2:
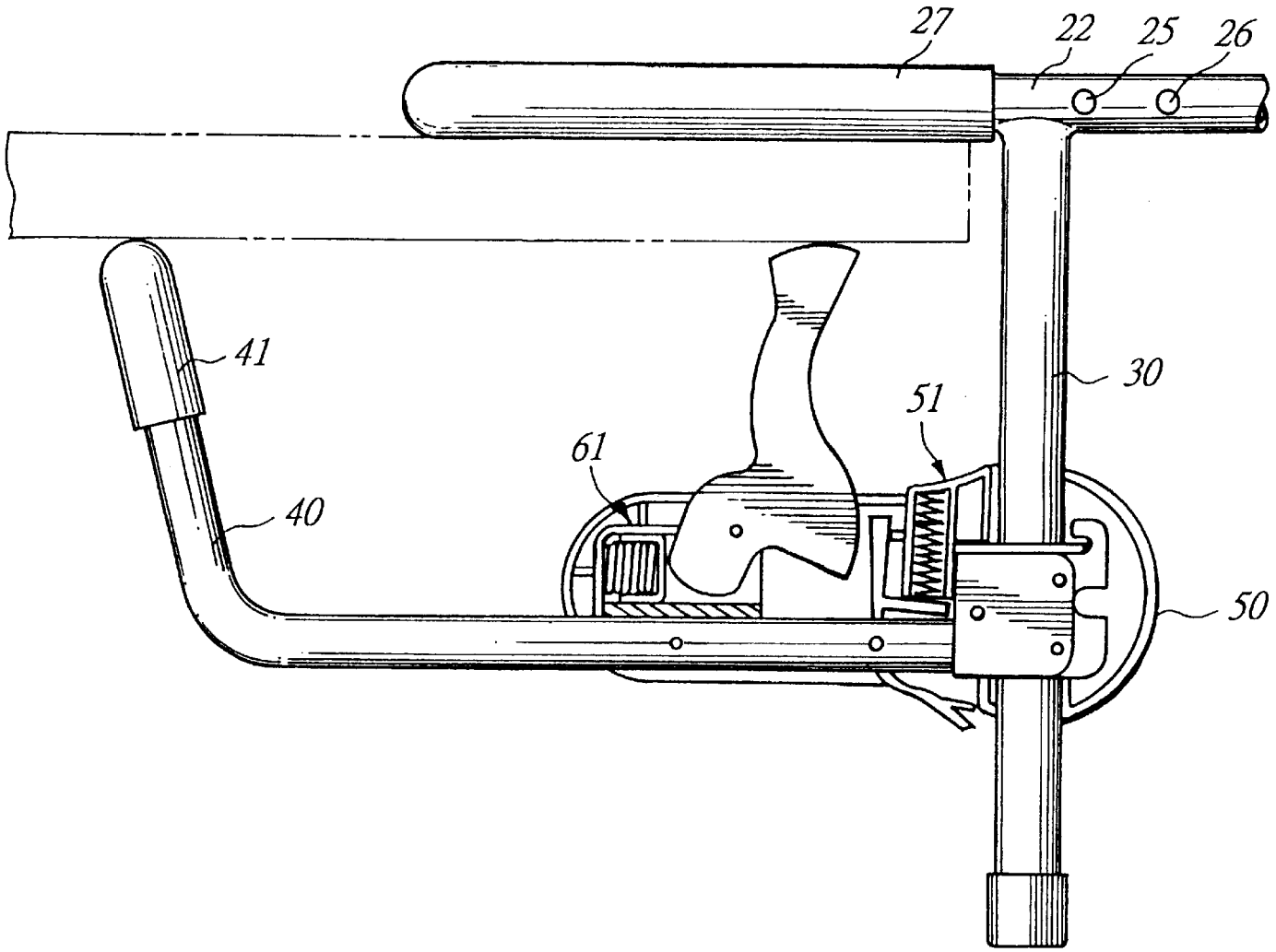
FIG. 2 is a side view of showing the structure of the left clamping portion of the main body portion of the hook-on type baby seat in accordance with the present application, in which a locking button and an adjusting button is pressed down.
Figure 3:
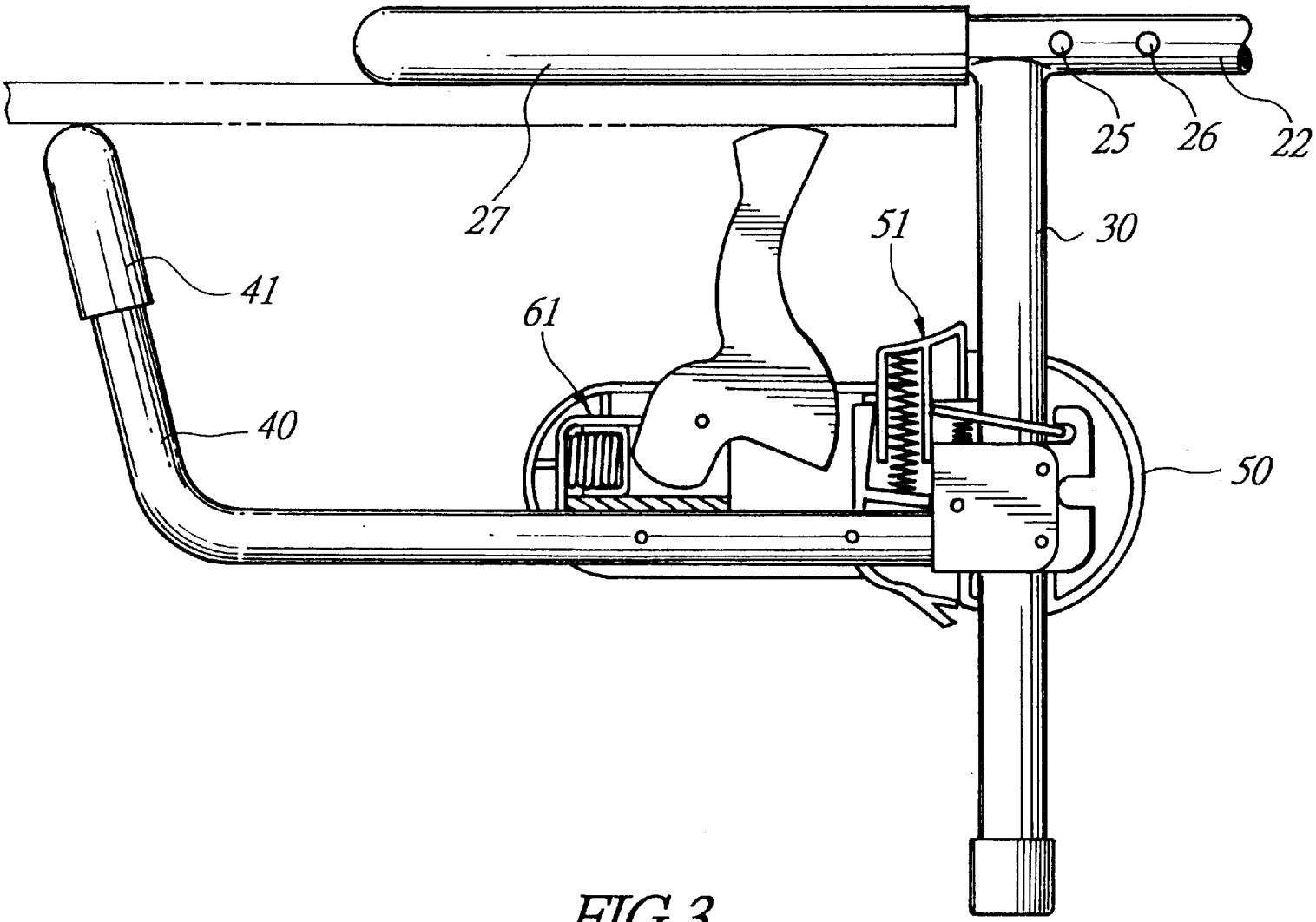
FIG. 3 is a side view of showing the structure of the left clamping portion of the main body portion of the hook-on type baby seat in accordance with the present application, in which a handle bar is in a gripping state.
Figure 4:
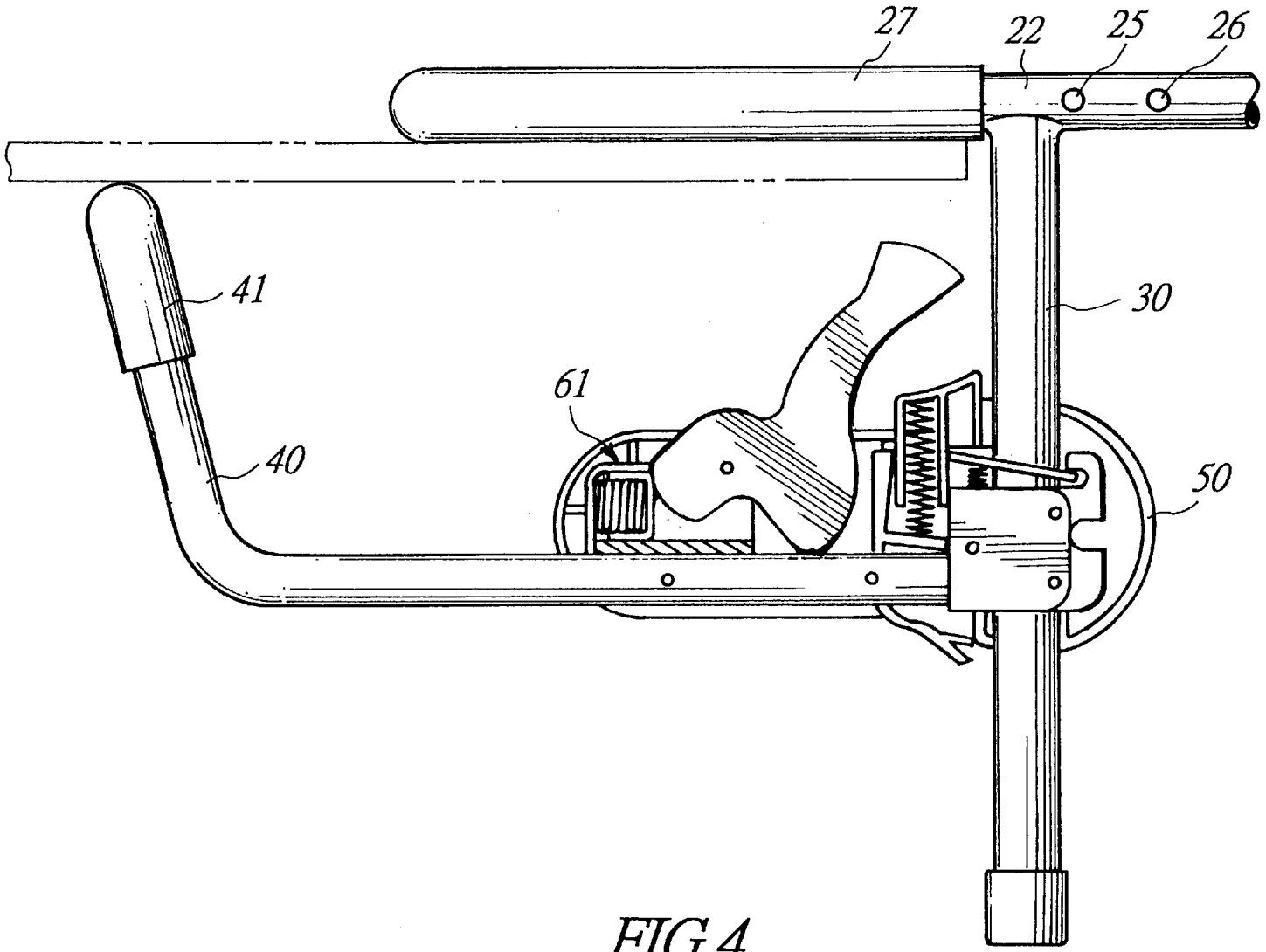
FIG. 4 is a side view of showing the structure of the left clamping portion of the main body portion of the hook-on type baby seat in accordance with the present application, in which a handle bar is in a releasing state.
Figure 5:
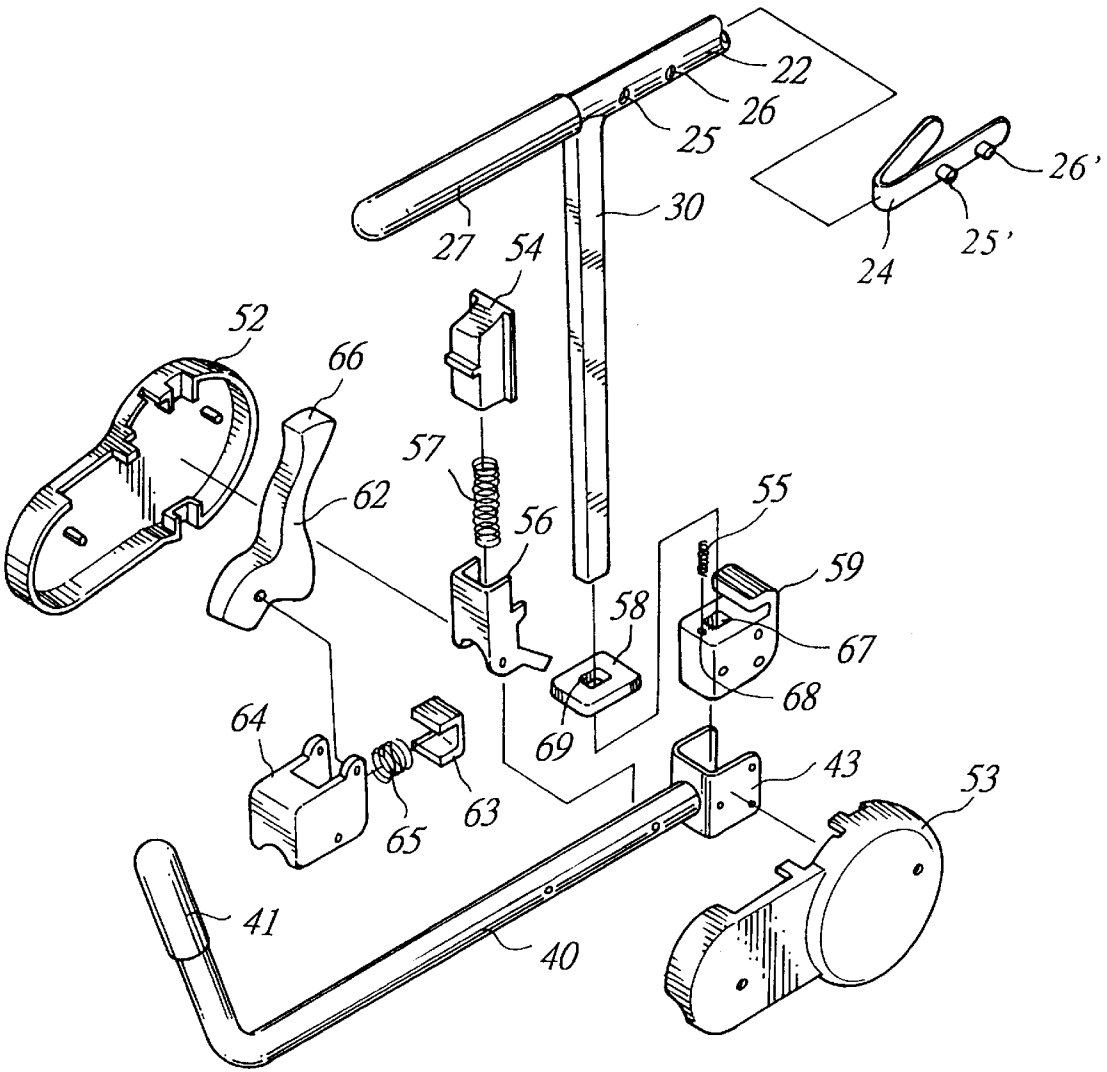
FIG. 5 is an explosive view for showing the left clamping portion of the main body portion of the hook-on type baby seat in accordance with the present application.

FIG. 2 is a side view of showing the structure of the left clamping portion of the main body portion of the hook-on type baby seat in accordance with the present application, in which a locking button and an adjusting button are pressed. FIG. 3 is a side view of showing the structure of the left clamping portion of the main body portion of the hook-on type baby seat in accordance with the present application, in which a handle bar is in a gripping state. FIG. 4 is a side view of showing the structure of the left clamping portion of the main body portion of the hook-on type baby seat in accordance with the present application, in which a handle bar is in a releasing state. FIG. 5 is an explosive view for showing the left clamping portion of the main body portion of the hook-on type baby seat in accordance with the present application.

With reference to FIG. 1 to FIG. 5, the U-shaped arm assembly 20 is comprised of a U-shaped arm member 21, a pair of straight arm members 22 and 23, and a pair of positioning flexible members 24 (only one is shown in FIG. 5). The inner diameter of the U-shaped arm member 21 is slightly larger than the outer diameter of each of the straight arm members 22 and 23. A pair of holes 25 and 26 are respectively formed on one end of each of the straight arm members 22 and 23 while only one hole (not shown) is formed on each of two ends of the U-shaped arm member 21, and two positioning pins 25' and 26' are provided on each of the positioning flexible members 24. The other end of each of the straight arm members 22 and 23 is covered with a rubber sleeve so as to form holding ends 27 and 28 which are adapted to overlie a gripped object, for example, a table and the like. With reference to FIG. 5, the positioning flexible member 24 is disposed in the straight arm member 22 with the two holes 25 and 26 on the straight arm member 22 being aligned with the two positioning pins 25' and 26' on the positioning flexible member 24. Then, the straight arm member 22 is inserted into a corresponding end of the U-shaped arm member 21. Subsequently, the two positioning pins 25' and 26' of the positioning flexible member 24 are pressed down to allow the outer hole 26 on the straight arm member 22 to be aligned with the hole on the corresponding end of the U-shaped arm member 21. And then, the straight arm member 22 is combined with the U-shaped arm member 21 after the two positioning pins 25' and 26' are released.

In FIG. 1, one end of each of the longitudinal arm members 30 and 35 is respectively soldered to each of the straight arm members 22 and 23 of the U-shaped arm assembly 20. With reference to FIG. 2, the longitudinal arm member 30 is soldered to a position between the holding ends 27 and the inner hole 25 of the straight arm members 22 of the U-shaped arm assembly 20. One end of each of the gripping arm members 40 and 45 is covered with a rubber sleeve so as to form gripping ends 41 and 42 which are bent upwardly while the other end is formed to become a C-shaped member 43 (only one is shown in FIG. 2) for attaching to the corresponding longitudinal arm member 30.

With reference to FIGS. 2 and 5, the elevation controlling and adjusting member 50 includes an elevation adjusting and locking portion 51, a release-or-grip control portion 61, a right cover 52 and a left cover 53. The elevation adjusting and locking portion 51 is composed of an adjusting button 54, a first spring 55, a locking button 56, a second spring 57, a stop strip 58 and a joint block 59. A first through hole 67 is formed in the middle of the joint block 59 for allowing the longitudinal arm member 30 to penetrate therethrough, and a cavity 68 is disposed in the vicinity of the through hole 67 in the joint block 59. Also, a second through hole 69 is formed in the middle of the stop strip 58 for allowing the longitudinal arm member 30 to penetrate therethrough.

The assembly of the elevation controlling and adjusting member 50 is as follows. First, the joint block 59 is jointed with the C-shaped member 43 of the gripping arm member 40. And then, the longitudinal arm member 30 sequentially penetrates through the first and second through holes 67 and 69 of the joint block 59 and the stop strip 58, respectively. The first spring 55 is disposed in the cavity 68 and depressed by one end of the stop strip 58 while the other end thereof is scarf-jointed into a groove of the joint block 59. The second spring 57 is disposed in the locking button 56 and covered with the adjusting button 54 so as to be sandwiched between the adjusting button 54 and the locking button 56.

The operation of the elevation adjusting and locking portion 51 will be explained with reference to FIG. 2. When the elevation adjusting and locking portion 51 is in a normal state, the stop strip 58 is kept to be at its operation position based on the elastic force of the first spring 55 in the cavity 68 of the joint block 59 to thereby hold the elevation controlling and adjusting member 50 in a certain position. When it is intended to move the elevation controlling and adjusting member 50 in a direction along the elevation of the longitudinal arm member 30, the first spring 55 is depressed by simultaneously pressing the adjusting button 54 and the locking button 56 so that the longitudinal arm member 30 is released from the stop strip 58 for allowing the gripping arm member 40 to be upwardly and downwardly movable in the elevation direction of the longitudinal arm member 30.

With reference to FIGS. 2 and 5, the release-or-grip control portion 61 is composed of a handle bar 62, a C-shaped movable component 63, a casing 64 and a third spring 65. A rubber pad 66 is provided on the top of the handle bar 62. The assembly of the release-or-grip control portion 61 is as follows. The third spring 65 is disposed in the C-shaped movable component 63 and subsequently covered with the casing 64, and the handle bar 62 is held against the rear side of the c-shaped movable component 63 so as to be pivotally connected to the casing 64.

The operation of the release-or-grip control portion 61 will be explained with reference to FIGS. 3 and 4. When the handle bar 62 is pulled to a locking position, a force is applied to the handle bar 62 by the third spring 65 and the rubber pad 66 on the handle bar 62 is supported against a bottom surface of the table so that the baby seat are further fastened to the table. When the handle bar 62 is pulled to a releasing position, the handle bar 62 is maintained in a releasing state by the elastic force of the third spring 65 while the rubber pad 66 on the handle bar 62 is released from the bottom surface of the table to facilitate the separation of the baby seat and the table.

With reference to FIG. 1, the seat portion 70 includes a seat cushion 71 and a back portion 72. The seat portion 70 is made of a soft cloth material and the back portion 72 is hanged on the U-shaped arm member 21 by sewing. Two ends of the back portion 72 passing over the soldered portions of the two ends of the longitudinal arm members 30 and 35 and the straight arm members 22 and 23 are fastened to the back portion 72 by buttons so that the seat portion 70 is secured to the U-shaped arm assembly 20 so as to prevent the seat portion 70 from sliding due to the action of a baby. A safety belt 73 is provided in the inner side of the seat portion 70 for fastening the baby so as to prevent the baby from falling to ground, which results in a dangerous situation. The rear side of the seat portion 70 is provided with a bag for a convenient purpose.

Such a baby seat achieves the following functions.

(1) An elevation adjusting function can be obtained for allowing the baby seat to be suitable for gripped objects with various thicknesses. This function can be carried out by using a self-lock action induced from the friction between the stop strip 58 and the longitudinal arm member 30. When the elevation adjusting and locking portion 51 is in a normal state, the stop strip 58 is maintained at its operating position through the elastic force of the first spring 55 so that the elevation controlling and adjusting member 50 is fixed at a certain position. When the baby seat needs to be adjusted, the adjusting button 54 and the locking button 56 of the elevation adjusting and locking portion 51 are simultaneously pressed so that the longitudinal arm member 30 is released from the stop strip 58 and the elevation controlling and adjusting member 50 is allowed to be upwardly and downwardly movable in the elevation direction of the longitudinal arm member 30.

(2) A function of securely locking the baby seat to prevent from misoperation is obtained so that the use of the baby seat is safer and more reliable. This function can be carried out by an allied operation of the adjusting button 54 and the locking button 56 of the elevation adjusting and locking portion 51. When the locking button 56 is not pressed, the longitudinal arm member 30 cannot be released from the stop strip 58 by pressing only the adjusting button 54, and the relative position between the locking button 56 and the adjusting button 54 is maintained by the second spring 57.

(3) Functions of gripping, locking and releasing of the release-or-grip control portion 61 is obtained by applying a self-lock principle to keep the handle bar 62 more reliably tightly locked. When the handle bar 62 is in a locking state and the baby seat is tightly gripped and locked, a pre-pressing force is applied to the handle bar 62 by the third spring 65. At this time, if the baby seat is pulled outside, the baby seat will be more tightly gripped since the relation between the handle bar 62 and the gripped object is in a self-lock state due to the friction therebetween. When the handle bar 62 is in a releasing state, the handle bar 62 is separated from the gripped object and will be kept in the releasing state due to the elastic force of the third spring 65.

Therefore, as compared with the conventional baby seat, the operation of the hook-on type baby seat in accordance with the present invention is simple and labor-saving. The baby seat can be adjusted so as to be suitable for gripped objects with various thicknesses, as long as the adjusting button and the locking button are pressed at the same time. The gripping and releasing operations of the baby seat can be realized by only pulling the handle bar forwardly and backwardly. In addition, the baby seat is comfortable in use and pleasant to the eyes since the baby seat is made of soft cloth. Further, the additional bag makes the use of the baby seat more convenient, and the compact retracting size is in favor of the carry and the portability of the baby seat.

While the present invention has been described in detail and pictorially in the accompanying drawings, it is not limited to such details since many changes and modifications recognizable to those skilled in the art may be made to the invention without departing from the spirit and the scope thereof.

What is claimed is:

1. A hook-on type baby seat, comprising:

a seat portion, and a main body portion; said main body portion including:

a U-shaped arm assembly to support said seat portion on an upper surface of a gripped object, said U-shaped arm assembly comprising a U-shaped arm member, a pair of straight arm members, a rubber sleeve to cover an end of each of said straight arm members to form a holding end adapted to overlie said gripped object, and a pair of positioning flexible members;

a pair of longitudinal arm members, each of said members being attached to said U-shaped arm assembly;

a pair of gripping arm members to grip or release said gripped object, wherein one end of each of the gripping arm members is formed to bend upwardly, and a second end thereof is formed as a C-shaped member for attachment to a corresponding longitudinal arm member; and a pair of elevation controlling and adjusting members combined with said pair of longitudinal arm members and gripping arm members to allow said pair of gripping arm members to be upwardly and downwardly movable in an elevation direction of said longitudinal arm member so as to adjust and lock an elevation position of said pair of gripping arm members;

wherein each of said elevation controlling and adjusting members comprises an elevation adjusting a locking portion, a release-or-grip control portion, a right cover and a left cover, and each of said elevation adjusting and locking portions comprises an adjusting button, a first spring, a locking button, a second spring, a stop strip, and a joint block, and each of said release-or-grip control portions comprises a handle bar, a C-shaped movable component, a casing and a third spring.

2. A hook-on type baby seat as claimed in claim 1, wherein each of said handle bars is further provided with a rubber pad;

wherein in a locking position, force is applied by said third spring to said handle bar such that said baby seat further grips said gripped object, and in a releasing position said rubber pad on said handle is moved away from a bottom surface of said gripped object to facilitate separation of said baby seat from said gripped object.

3. A hook-on type baby seat as claimed in claim 1, wherein said seat portion includes at least one of (a) a seat cushion, (b) a back portion attached to said U-shaped arm assembly, and (c) a safety belt disposed in an inner portion of said seat portion.

4. A hook-on type baby seat as claimed in claim 1, wherein said gripped object is a table top.

5. A hook-on type baby seat as claimed in claim 1, wherein each of said longitudinal arm members is soldered to said U-shaped arm assembly.

6. A hook-on type baby seat, comprising:

a seat portion; and a main body portion that includes:

a U-shaped arm assembly to support said baby seat from an upper surface of a gripped object;

first and second longitudinal arm members each having an end attached to said U-shaped arm assembly;

first and second gripping arm members to release-or-grip said gripped object, each of said arm members having a first end curved upwardly, and having a second end attached to one of said longitudinal arm members; and a pair of elevation controlling and adjusting members each comprising an elevation adjusting and locking portion that includes a stop strip and a joint block and a first spring disposed therebetween, an adjustment button and a locking button and a second spring disposed therebetween, and further comprising a release-or-grip control portion including a handle bar pivotally coupled to a casing, a C-shaped movable member, and a third spring disposed to urge said movable member away from said casing;

said elevation controlling and adjusting members coupled to said longitudinal arm members and said gripping arm members to facilitate upward and downward movement of said gripping arm members in an elevation direction of said longitudinal arm member so as to adjust and lock an elevation position of said gripping arm members.

7. The baby seat of claim 6, wherein said seat portion includes at least one of (a) a seat cushion, (b) a back portion attached to said U-shaped arm assembly, and (c) a safety belt disposed in an inner portion of said seat portion.

8. The baby seat of claim 6, wherein said U-shaped arm assembly comprises a U-shaped arm member, a pair of straight arm members, and a pair of positioning flexible members.

9. The baby seat of claim 6, further including at least one friction-enhancing sleeve attached to said U-shaped arm assembly to enhance friction with said gripped object.

10. The baby seat of claim 6, wherein each said handle bar includes a rubber pad, and said handle bar is movable between in a locking position and a releasing position;

wherein in said locking position, each said third spring urges an associated said handle bar to cause said baby seat to enhance gripping of said gripped object; and in said releasing position each said rubber pad is moved away from a lower surface of said gripped object.

11. The baby seat of claim 6, wherein said gripped object includes a table top.

12. The baby seat of claim 6, wherein each said end of a longitudinal arm member is attached to said U-shaped arm assembly with solder.

* * * * *